United States Patent [19]

Kawasumi

[11] 4,276,750

[45] Jul. 7, 1981

[54] FLAKE ICE VENDING MACHINE

[75] Inventor: Sakichi Kawasumi, Toyoake, Japan

[73] Assignee: Hoshizaki Electric Co., Ltd., Aichi, Japan

[21] Appl. No.: 111,008

[22] Filed: Jan. 9, 1980

Related U.S. Application Data

[63] Continuation of Ser. No. 826,135, Aug. 19, 1977, abandoned.

[51] Int. Cl.[3] ..... F25C 5/14

[52] U.S. Cl. ..... 62/137; 62/320; 62/354; 221/96; 222/146 C

[58] Field of Search ..... 62/354, 389, 391, 320, 62/321; 222/146 C, 148, ; 221/96; 141/82, 91, 104

[56] References Cited

U.S. PATENT DOCUMENTS

| | | | |
|---|---|---|---|
| 2,984,059 | 5/1961 | Hollingsworth | 141/104 X |
| 3,141,573 | 7/1964 | Patch et al. | 222/146 C X |
| 3,145,878 | 8/1964 | Bert | 62/389 |
| 3,151,668 | 10/1964 | Zimmermann | 62/344 X |
| 3,638,392 | 2/1972 | Welker, Jr. et al. | 141/82 X |
| 3,642,174 | 2/1972 | Cornelius | 222/146 C X |
| 3,769,809 | 11/1973 | Robinson et al. | 62/354 X |
| 3,995,770 | 12/1976 | Schwitters | 222/148 X |
| 4,058,383 | 11/1977 | Peterson | 222/148 |

*Primary Examiner*—William E. Tapolcai, Jr.
*Attorney, Agent, or Firm*—Wenderoth, Lind & Ponack

[57] ABSTRACT

A flake ice vending machine for vending disposable receptacles filled with a mixture of flake ice and a flavored syrup, and including an auger type ice maker, a storage bin for storing the ice formed by the ice maker, an ice slicer for slicing the ice formed by the ice maker, and a discharge chute for discharging the flake ice formed by the ice slicer. Additional mechanisms are provided for dispensing a flavored syrup into the disposable receptacle and mechanisms for washing the area in which the disposable filled receptacles are provided so as to wash away the surplus syrup and ice.

10 Claims, 5 Drawing Figures

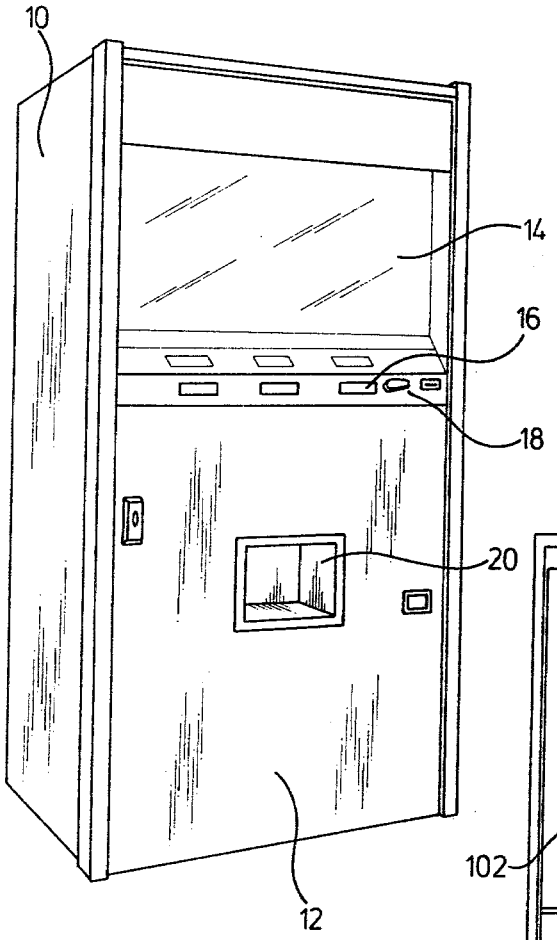
FIG.1
FIG.2
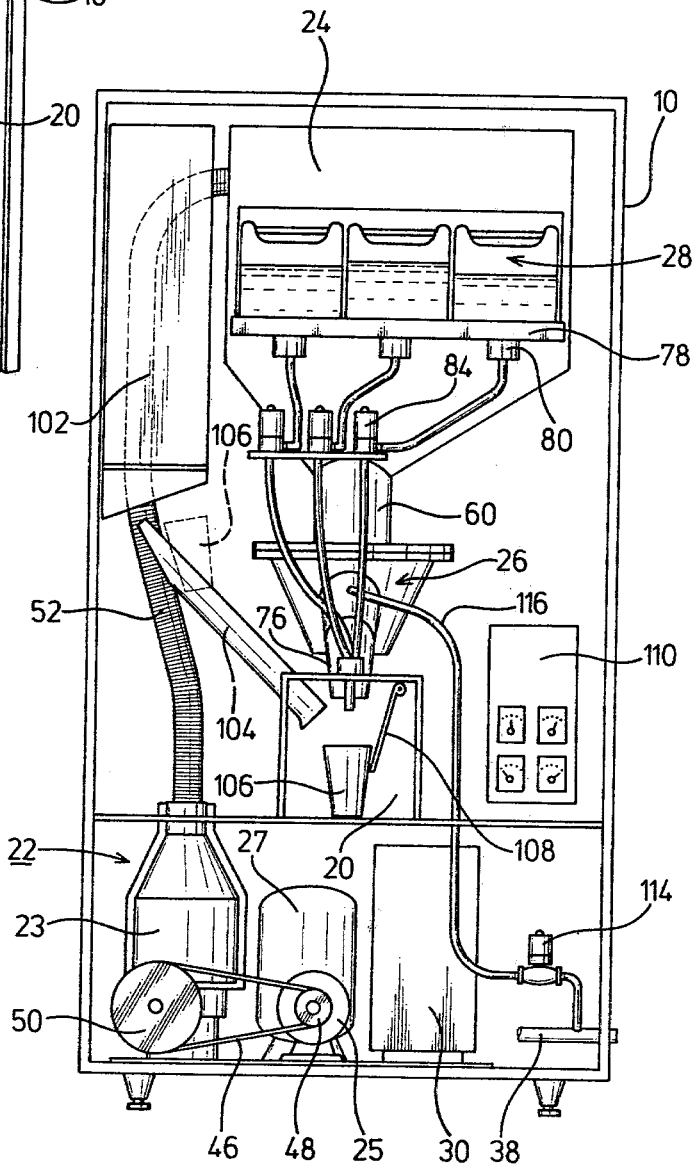

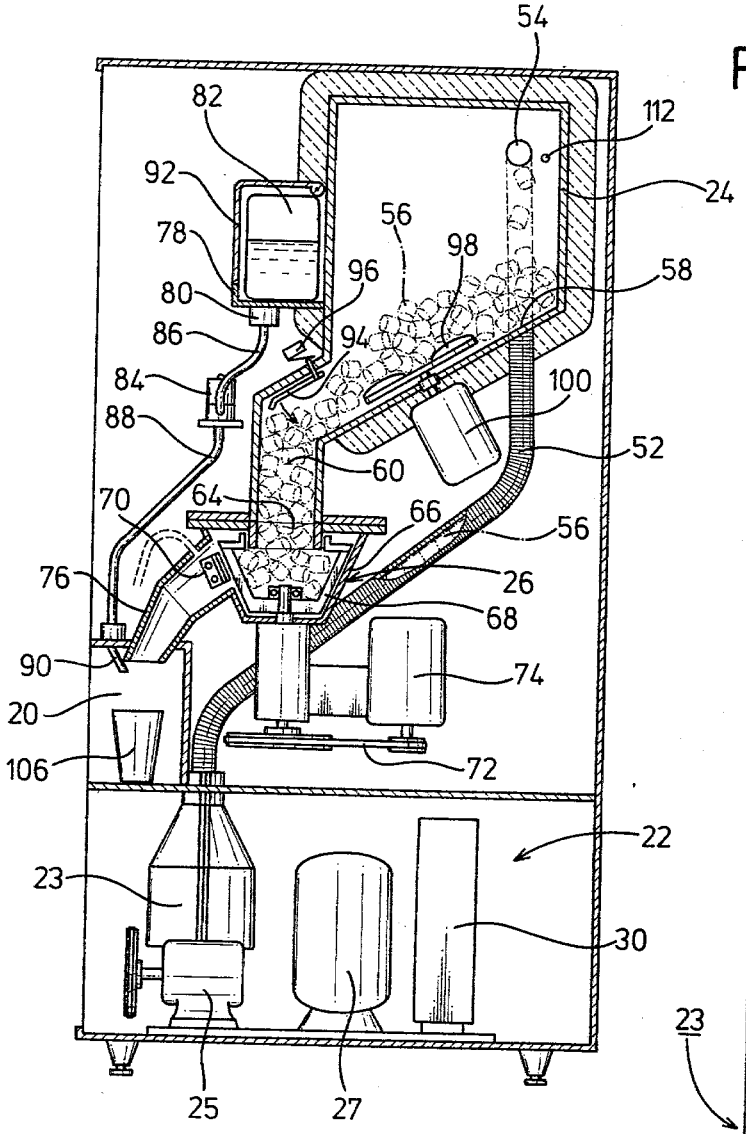
FIG.3
FIG.4
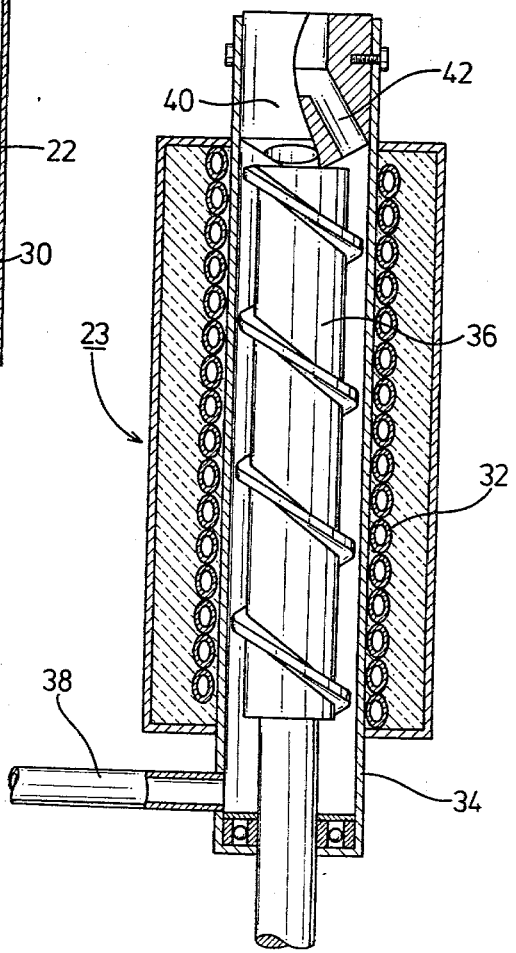

FLAKE ICE VENDING MACHINE

This application is a continuation application of Ser. No. 826,135, filed Aug. 19, 1977, now abandoned.

BACKGROUND AND SUMMARY OF THE INVENTION

This invention relates to a flake ice vending machine and more particularly to a flake ice vending machine in which an ice layer formed on an inner circumferential wall surface of a freezing cylinder of an auger type ice making mechanism is scraped by the auger and the scraped ice is continuously compressed into a number of ice masses which are transferred to an ice storage chamber for storing the ice masses therein and in turn the ice masses of a predetermined amount are supplied to an ice slicing machine under a coin controlled operation for discharging the flake ice into a receptacle and then a flavored liquid, such as syrup, is poured onto the flake ice with an improved sanitary condition.

Hitherto, block ice is conveniently subjected to a manually operated or a motor-driven ice slicing machine to obtain the desired flake ice to which is added syrup of various flavors, such as strawberry, melon and the like, and offered for refreshment in the summer season. For this purpose, the ice blocks are usually supplied by the ice shop and the ice blocks are treated manually in an atmospheric environment under unsanitary conditions. Further, at present the offering of the flake ice is limited to midsummer although it might be enjoyed through four seasons like beverages and ice-cream if the flake ice could be obtained sanitarily and automatically at any time of the year.

To eliminate the foregoing disadvantages and inconveniences, there is provided in accordance with the invention a flake ice vending machine in which the ice mass intended to be flaked is prepared automatically and supplied to an ice slicing machine for flaking and to the flake ice thus obtained is added the flavored syrup without being subjected to a direct manual operation and exposed to atmospheric environment.

A principal object of the present invention is to provide a flake ice vending machine which comprises an auger type ice making mechanism including an auger for scraping an ice layer formed on an inner circumferential surface of the freezing cylinder and a press head for compressing the scraped ice into a number of the ice masses, means for transferring the ice masses extruded from the ice making mechanism, an ice storage chamber for receiving and storing the ice masses, means for slicing the ice masses supplied from the ice storage chamber to discharge a flake ice into a receptacle, means for pouring a selected flavored liquid onto the flake ice in the receptacle and a coin controlled mechanism operatively connected to a vending control circuit for effecting ice making, ice slicing and pouring of the flavored liquid continuously.

If discharging of the flake ice into the receptacle and pouring of the flavored liquid onto the flake ice could be accomplished alternately, the flake ice in the receptacle might be sufficiently impregnated with the flavored liquid. For this purpose, in accordance with the invention, the coin controlled mechanism is provided with an intermittent means for effecting the discharge of the flake ice into the receptacle and pouring of the flavored liquid onto the flake ice in the receptacle intermittently and alternately.

When the flake ice vending machine in accordance with the invention is operated continuously, the residual flake ice is deposited in the dispensing outlet tray and on the other parts. It is therefore desired to melt the deposited ice by supplying water thereto. For this end, the vending machine in accordance with the present invention is further provided with a water supply system connected to an external water supply source for discharging water to melt the deposited flake ice before the succeeding vending cycle is started.

The water supply system typically comprises a pipe line branched from a water supply line against the auger type ice making unit through a convenient electromagnetic valve and opened into a chute adjacent an outlet of the ice slicing means.

The means for transferring the ice masses extruded from the ice making unit to the storage chamber comprises a flexible tube which has one end connected to an outlet of the auger type ice making unit and has its opposite end connected to an inlet of the ice storage chamber.

Further, the ice storage chamber at its upper portion is preferably provided with a thermostat for measuring an upper storing limit of the ice masses and is provided at its bottom portion with a detecting plate for detecting presence of the ice masses and a mechanism for subsequently activating an agitator or screw conveyor provided on the bottom of the ice storage chamber.

Other objects and advantages of the invention will be apparent from the following disclosure taken in conjunction with the accompanying drawings, in which:

BRIEF DESCRIPTION OF THE DRAWINGS

FIG. 1 is a perspective view of the flake ice vending machine in accordance with the present invention;

FIG. 2 is a front elevation of the machine in an opened position;

FIG. 3 is a pictorial view similar to FIG. 2 but partially sectioned;

FIG. 4 is a longitudinally sectioned view of the auger ice making mechanism to be used in the vending machine in accordance with the invention.

DESCRIPTION OF THE PREFERRED EMBODIMENT

Figure 5:
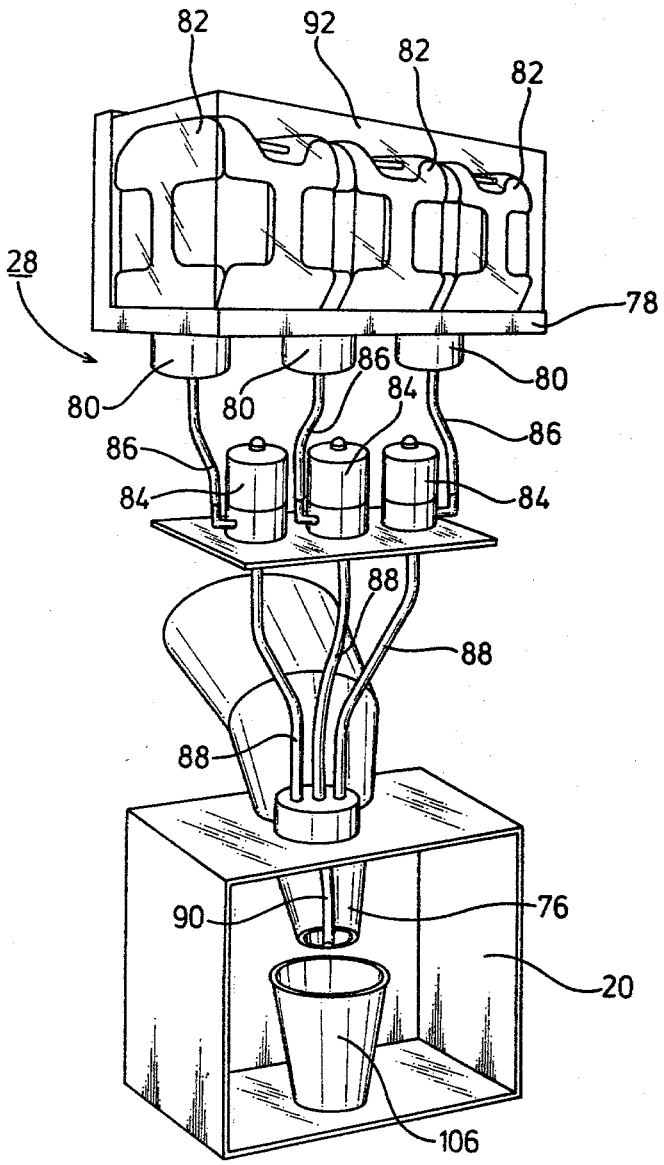
FIG. 5 is a perspective view of the flavor storaging and discharging arrangement.

In the accompanying drawings, the reference numeral 10 represents a housing of the flake ice vending machine in accordance with the invention. In the front door 12 of the housing 10 are provided a display panel 14 for showing the articles offered and an operation unit 18 having selecting buttons 16 for selection of the flavored liquids such as strawberry liquid, orange liquid, lemon liquid and the like and a dispensing outlet tray 20.

FIG. 2 is a front elevation of the vending machine in which the front door 12 is opened to show the internal arrangements of the machine which includes essentially an ice making unit 22 disposed at the bottom of the housing 10, an ice storage chamber 24 arranged at an upper portion of the housing 10, an ice slicing apparatus 26 supported resiliently at the middle portion of the housing 10 and a flavored liquid storage and supply system.

As best shown in FIG. 2, the ice making unit 22 includes an auger type ice making unit 22, a motor 25 for driving the ice making machine 23, a compressor 27 for compressing the coolant to be supplied to the ice making unit 22 and a condenser 30 for condensing the compressed high temperature and high pressure gaseous coolant into a liquid coolant.

As shown in FIG. 4, the auger type ice making unit 22 comprises a refrigerant conduit 32 connected to the refrigeration system and wrapped around a freezing cylinder 34 in which an auger 36 having a spiral scraper is turnably arranged and a water supply pipe 38 connected to an external water source (not shown) for supplying the water into the cylinder 34 through the bottom thereof for growing the ice on an inner circumferential wall of the cylinder 34.

The ice thus formed is successively scraped by turning the auger 36 and then transferred upwardly to pass through a passage 42 provided in a press head 40 mounted on the freezing cylinder 34 of the ice making unit 22 for producing a number of the ice masses.

The turning force of the auger 36 is derived from the motor 25 through a pulley 48, a belt 46 and a pulley 50. From an opening of the press head 40 is upwardly derived a flexible conduit of preferably poor heat conducting material which is communicated into an opening 54 of the ice storage chamber 24. Namely, during the continuous operation of the auger type ice making unit 22, the ice layer formed on the inner circumferential wall surface of the freezing cylinder 34 is scraped by the auger 36 and in turn compressed by the press head 40 into a number of the ice masses 56 which are pushed upwardly in alignment through the flexible conduit 52 and drop seriatim into the storage chamber 24 for storing.

The ice storage chamber 24 is a hopper type container having an inclined bottom which is converged into an ice delivery chute 60. Below the ice storage tank 24, there is provided an ice slicer 26 having an ice passage 64 which is communicated with the ice delivery chute 60. The ice slicer 26 comprises a casing 66 and a rotor 68 which is turnably arranged in the casing 66 where the ice masses 56 fed through the passage 64 are urged against the cutter 70 provided in the inner circumferential wall of the casing 66 under the function of the high speed turning of the rotor 68 for the continuous slicing operation. The turning force of the rotor 68 is derived from an electric motor 74 through a belt 72. The sliced ice or the flake ice is discharged from a delivery chute 76 opened into the dispensing outlet tray 20 provided in the front door of the housing 10. The ice storage chamber 24 and the ice slicer 26 are preferably coated with an appropriate heat insulating material, such as glass wool and the like, for possible prevention of the external heat transmission to minimize the melting loss of the ice masses stored in the chamber.

In the upper portion of the housing 10 there is provided a horizontally extending support plate 78 beneath which a desired number of containers 80 are mounted to receive a predetermined quantity of the flavored liquid from cartridge tanks 82 placed in reverse on the support plate 78.

Under the container 80 are arranged conventional electromagnetic valves 84 which are controlled by the signals from the vending control circuit and connected with the outlets of the container 80 through vinyl pipes 86. Flexible pipes 88 derived from the outlets of the valves 84 are converged into a single discharge pipe 90 which is extended into the delivery chute 76.

The predetermined amount of the liquid supplied from the cartridge liquid tank 82 is retained in the containers 80 and the pipes 86. When the operation starts the electromagnetic valve 84 is opened by the signal to discharge the predetermined amount of the liquid through the pipes 88 and the discharge pipe 90 as best shown in FIG. 5.

The cartridge liquid tank 82 at its rear side is preferably made into contact with a portion which is not coated by the heat-insulating material of the ice storage chamber so that the liquid is cooled to a temperature sufficient enough not to melt the flake ice when added thereto. The cartridge liquid tanks 82 are preferrably covered with a plastic lid 92 as shown in FIG. 5 for the purpose of keeping the liquid tanks cold.

In the ice storage chamber 24 at its bottom portion there is provided a detecting lug 94 above the ice delivery chute 60 which is operatively connected to a detecting switch 96 for measuring the presence of the ice masses stored in the chamber.

In FIG. 3, the inclined bottom 58 of the ice storage chamber 24 is provided with a stirrer 98 which is driven by a motor 100 provided outside the chamber 24.

Returning to FIG. 2, the reference numeral 102 represents a cup supply conduit, 104 a cup feed chute, 106 a cup, 108 a cup detecting bar which is operatively connected to a micro switch (not shown) to detect the feed of the cup and to send a signal to the vending control circuit, and 110 denotes a vending control unit. The reference numeral 114 stands for an electromagnetic valve provided on a line 116 branched from the water supply line 38 connected to the external water source and opened into the flake ice delivery chute 76. The electromagnetic valve 114 is operatively connected to the vending control circuit and constructed to open for a predetermined period just before the first commencement of the operation of the ice slicer 26, so that water supplied from the external water supply source through the line 116 is discharged into the chute 76 and the dispensing outlet tray 20 for washing out the residual flake ice.

The operation of the flake ice vending machine in accordance with the present invention will be hereinafter described.

At first, when an operation of the ice making unit 22 is commenced, water is supplied to the bottom of the freezing cylinder 34 of the auger type ice making mechanism 23 through the water supply pipe 38 while the freezing cylinder 34 is relatively refrigerated under the freezing function of the refrigerant coil 32 connected to the refrigeration system to grow an ice layer on the inner circumferential wall of the cylinder 34. When the motor 25 is activated the auger 36 is turned to scrape the ice layer formed on the inner circumferential wall of the cylinder with upward movement of the scraped ice which passes under compression through the passage provided in the press head 40 whereby a number of the ice masses 56 are continuously obtained. A further continuous ice making operation brings a rod of the ice masses in the flexible tube 52 as shown in FIG. 3 and the rod of the ice masses is urged upwardly to fall through the opening 54 into the ice chamber 24 in the form of the ice masses. The ice masses 56 thus obtained are further fed through the ice chute 60 into the ice slicer 26 until the ice storage chamber 24 is filled to a predetermined upper limit where a thermostat 112 is energized to stop the operation of the ice making unit 22 and for placing same in the waiting position until the next operation cycle. During the waiting period, the ice masses stored in the slicer 26 are slowly melted into water which may be discharged outside through a convenient drain (not shown).

When the customer puts a coin into the dispensing mechanism and pushes one of the selecting buttons 16, the vending control circuit (not shown) actuates the following sequential operations.

(1) A predetermined amount of water is discharged from the delivery chute 76 to remove the ice remaining in the chute 76 and the dispensing tray 20. Water is supplied from the external water supply source through the pipe 116 and the electromagnetic valve 114.

(2) A cup 106 is supplied from the cup supply conduit 102 through the chute 104. When the cup stands at a predetermined position, the detecting bar 108 actuates a mechanism to generate a signal indicating the presence of the cup for the next operational sequence.

(3) The ice slicer 26 operates for a predetermined period to discharge the flake ice through the chute 76 to the cup 106.

(4) The electromagnetic valve 84 is opened to discharge a predetermined amount of the flavored liquid stored in the container 80 and the flexible pipe 86 through the line 88 and the discharge pipe 90 onto the flake ice filled in the cup 106.

In the foregoing sequential operations, (3) and (4) may be carried out alternately and intermittently to pour the flavored liquid at two or more stages which facilitate the immersion of the liquid into the flake ice in the cup.

After the predetermined amount of the flavored liquid is supplied, the electromagnetic valve 84 is closed and then an equivalent amount of the liquid is again supplied from the cartridge tank 82. To the ice slicer 26 the ice masses in the amount equivalent to the consumed ice masses are supplied from the ice storage chamber 24 for the next waiting cycle. The ice masses 56 in the storage chamber 24 are fed into the slicer 26 progressively from the lowermost stock. However, sometimes the ice masses are bridged with one another to form a cavity which disturbs the feed of the ice masses into the slicer. This undesired condition is detected by the detector 94 and in turn the switch 96 is energized to drive the motor 100 for activating the agitator 98. Thus, the ice masses in the storage chamber are mixed for releasing the bridges, of the ice masses, enabling same to be transferred into the slicer 26 smoothly. Then, the detector 94 is again pressed by the ice masses 56 to open the switch 96 for stopping the operation of the motor 100 and the agitator 98.

As hereinbefore fully described, the ice vending machine in accordance with the present invention may achieve making ice, slicing same, and pouring the flavored liquid without requiring any manual treatment during the operation.

It will be apparent that obvious variations can be made from the above description without, however, departing from the scope of the invention.

What I claim is:

1. In a flake ice vending machine for vending disposable receptacles filled with a mixture of flake ice and a flavored syrup, the improved combination comprising:

an auger type ice making means comprising a refrigerated cylinder and rotating auger contained within said cylinder, said auger scraping ice formed on an inner circumferential surface of said cylinder;

a storage means for storing said ice formed by said ice making means, said storage means mechanically connected to said ice making means by a conduit, said auger of said ice making means feeding said ice formed from said ice making means to said storage means through said conduit;

a first means provided at an upper portion of said storage means for measuring an upper storage limit of said ice stored therein and for controlling said ice making means;

a second means provided at a bottom portion of said storage means for measuring the presence of ice stored therein;

an agitator means located within said storage means and controlled by said second means for agitating said ice formed by said ice making means;

an ice slicer means for slicing said ice formed by said ice making means into flake ice, said slicer means mechanically connected to said storage means by a feed means for feeding said ice from said storage means to said slicer means; and a discharge means for discharging said flake ice, said discharge means mechanically connected to said slicer means; said improved combination producing flake ice for dispensing.

2. A flake ice vending machine as in claim 1 further comprising means for storing a plurality of disposable receptacles and dispensing one of said plurality of disposable receptacles, said dispensed one of said plurality of disposable receptacles arranged beneath said discharge means for receiving said flake ice.

3. A flake ice vending machine as in claim 2, further comprising a flavored syrup storing and dispensing means for storing a quantity of flavored syrup and dispensing a metered portion thereof into said dispensed one of said plurality of disposable receptacles.

4. A flake ice vending machine comprising:

an auger type ice making unit in which an ice layer formed on an inner circumferential wall surface of a freezing cylinder is scraped by an auger and then compressed by a press head into a plurality of ice masses;

a means for transferring the ice masses extruded from said ice making unit;

a storage chamber for storing the transferred ice masses;

a means for slicing the ice masses supplied from said storage chamber to discharge flake ice into a receptacle;

a means for pouring a selected flavored liquid onto the flake ice;

wherein the ice storage chamber at its upper portion is provided with a means for measuring an upper storage limit of the ice masses and for controlling said ice making unit and is provided at its bottom portion with a means for measuring the presence of the ice masses and for activating an agitator provided in the bottom of the ice storage chamber.

5. A flake ice vending machine comprising:

an auger type ice making unit in which an ice layer formed on an inner circumferential wall surface of a freezing cylinder is scraped by an auger and then compressed by a press head into a plurality of ice masses;

a means for transferring the ice masses extruded from said ice making unit;

a storage chamber for storing the transferred ice masses;

a means for slicing the ice masses supplied from said storage chamber to discharge flake ice into a receptacle;

a means for pouring a selected flavored liquid onto the flake ice;

wherein the ice storage chamber at its upper portion is provided with a means for measuring an upper storage limit of the ice masses and for controlling said ice making unit and is provided at its bottom portion with a means for measuring the presence of the ice masses and for activating a screw conveyor arranged in the bottom of the ice storage chamber.

6. A flake ice vending machine as claimed in claims 4 or 5, wherein the means for transferring the ice masses extruded from the ice making unit to the storage chamber comprises a flexible tube having one end is connected to an outlet of the auger type ice making unit and having its opposite end connected to an inlet of the ice storage chamber.

7. A flake ice vending machine as claimed in claims 4 or 5, further comprising a means for discharging water against a dispensing outlet tray for cleaning.

8. A flake ice vending machine as claimed in claim 7, wherein the water discharging means comprises a pipe line branched from a water supply line to the auger type ice making unit through an electromagnetic valve and opened into a chute adjacent the outlet of the ice slicing means.

9. A flake ice vending machine comprising:

an auger type ice making unit in which an ice layer formed on an inner circumferential wall surface of a freezing cylinder is scraped by an auger and then compressed by a press head to form a plurality of ice masses;

a means for transferring the ice masses extruded from said ice making unit;

a storage chamber for storing the transferred ice masses;

a means for slicing the ice masses supplied from said storage chamber to discharge a flake ice;

a means for storing and supplying a receptacle for receiving the flake ice into a dispensing outlet tray;

a means for pouring a flavored liquid onto the flake ice in the receptacle;

a means for discharging water against a dispensing outlet tray for cleaning;

wherein the ice storage chamber at it upper portion is provided with a means for measuring an upper storage limit of the ice masses and for controlling said ice making unit and is provided at its bottom portion with a means for measuring the presence of the ice masses and for activating an agitator provided in the bottom of the storage chamber.

10. A flake ice vending machine comprising:

an auger type ice making unit in which an ice layer formed on an inner circumferential wall surface of a freezing cylinder is scraped by an auger and then compressed by a press head to form a plurality of ice masses;

a means for transferring the ice masses extruded from said ice making unit;

a storage chamber for storing the transferred ice masses;

a means for slicing the ice masses supplied from said storage chamber to discharge a flake ice;

a means for storing and supplying a receptacle for receiving the flake ice into a dispensing outlet tray;

a means for pouring a flavored liquid onto the flake ice in the receptacle;

a means for discharging water against a dispensing outlet tray for cleaning;

wherein the ice storage chamber at its upper portion is provided with a means for measuring an upper storing limit of the ice masses and for controlling said ice making unit and is provided at its bottom portion with a means for measuring the presence of the ice masses and for activating a screw conveyor arranged in the bottom of the ice storage chamber.

* * * * *